United States Patent [19]

Wild et al.

[11] Patent Number: 5,014,848

[45] Date of Patent: May 14, 1991

[54] DEVICE FOR STORING TENNIS BALLS

[75] Inventors: Johann K. Wild, Augsburg; Nicole Egloffstein, Stadtbergen, both of Fed. Rep. of Germany

[73] Assignee: PMC Patents Management & Consulting (Luxembourg) Holding S.A., Luxembourg, Fed. Rep. of Germany

[21] Appl. No.: 474,009

[22] PCT Filed: Aug. 23, 1989

[86] PCT No.: PCT/EP89/00995

§ 371 Date: Apr. 10, 1990

§ 102(e) Date: Apr. 10, 1990

[87] PCT Pub. No.: WO90/01973

PCT Pub. Date: Mar. 8, 1990

[51] Int. Cl.[5] ..... B65D 85/00

[52] U.S. Cl. ..... 206/315.9

[58] Field of Search ..... 206/315.9, 315.91

[56] References Cited

U.S. PATENT DOCUMENTS

| | | | |
|---|---|---|---|
| 3,415,357 | 12/1968 | Van Natter | 206/315.9 |
| 3,853,222 | 12/1974 | Helms | 206/315.9 |
| 3,888,347 | 6/1975 | Kramer | 206/315.9 |
| 4,019,629 | 4/1977 | Dubner et al. | 206/315.9 |
| 4,428,478 | 1/1984 | Hoffman | 206/315.9 |

FOREIGN PATENT DOCUMENTS

| | | | |
|---|---|---|---|
| 8702822 | 2/1987 | Fed. Rep. of Germany | 206/315.9 |

*Primary Examiner*—William I. Price

*Attorney, Agent, or Firm*—Learman & McCulloch

[57] ABSTRACT

The invention relates to a device for storing tennis balls under pressure, in which the pump housing which is constructed as a handle is connected to the container which holds the tennis balls in such a way there there is an opening for a hand to reach through between the pump housing and the container and in the inserted state the pump handle also projects over the container. Such a device is distinguished by particularly comfortable and absolutely safe handling.

12 Claims, 3 Drawing Sheets

DEVICE FOR STORING TENNIS BALLS

BACKGROUND OF THE INVENTION (1) Technical Field

The invention relates to a device for storing tennis balls under pressure.

(2) Description of the Prior Art

Devices for storing tennis balls are known for example from DE-U-87 02 822. The pump housing of this device is arranged with a very small space right beside the tubular container, and in the inserted state the pump handle ends approximately in the centre of the container. Because of this construction effort is required to hold the container and pumping involves a considerable danger of injury (pinching the fingers between the pump handle and the container).

The same disadvantages beset the device which is known from U.S. Pat. No. 3,888,347, in which the pump housing is arranged immediately adjacent to the container, without a space, and, similarly in this case and when in the inserted state the pump handle ends approximately in the centre of the container.

SUMMARY OF THE INVENTION

The object of the invention, therefore, is to construct a device in which it is possible to hold the device comfortably and easy pumping is possible without danger - and at the same time production is simple and economic.

Accordingly, the subject invention is directed toward a device for storing tennis balls under pressure including a tubular container which is provided with a screwable cover on at least one end. The device further includes a piston pump with a pump housing arranged adjacent to the container and connected to one end region of the container and with a piston which is movable in the pump housing by means of a pump handle. A non-return valve is included which connects the pump pressure chamber to the interior of the container. The device is characterized in that the pump housing, which is constructed as a handle, is also connected to the other end region of the container so that there is an opening for a hand to reach through between the pump housing and a container and in the inserted state the pump handle also projects over the container.

THE DRAWINGS

The invention will be described in greater detail below with the aid of the accompanying drawings, wherein.

DESCRIPTION OF THE PREFERRED EMBODIMENT

Figure 1:
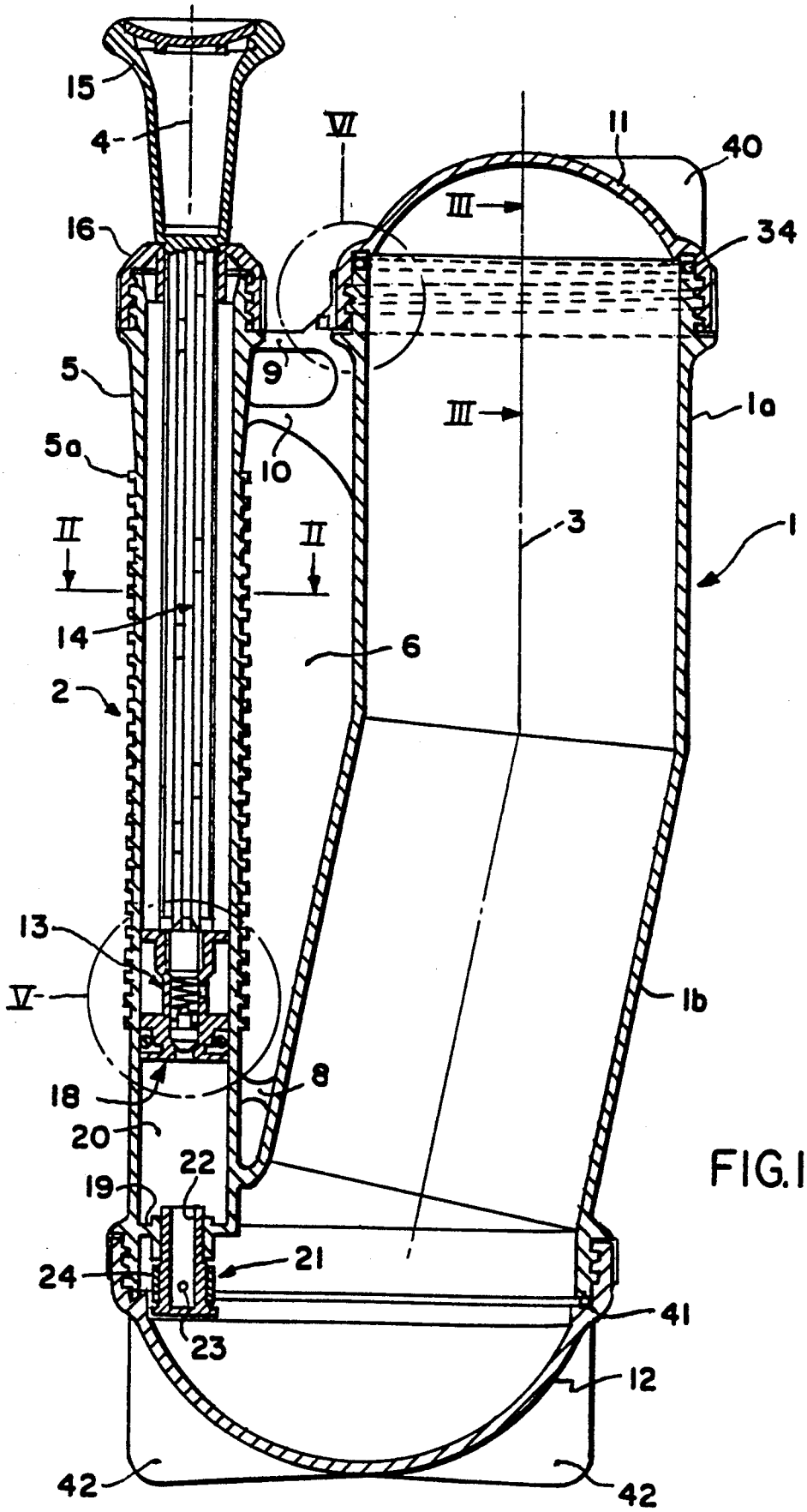
FIG. 1 is a longitudinal section through the device.

The device according to the invention for storing tennis balls under pressure is illustrated in the drawings and comprises a tubular container 1 and a piston pump 2.

The longitudinal axis 3 of the container 1 is bent in the central region of the height of the container so that the upper section 1*a* of the container 1 extends parallel to the axis 4 of the pump housing 5 of the piston pump 2, whilst the lower section 1*b* of the container 1 forms an acute angle with the axis 4 of the pump housing 5.

The pump housing of the piston pump 2 is arranged a sufficient distance from the container 1, so that there is an opening 6 for a hand to reach through between the pump housing 5 and the container 1, and—because of the described bent shape of the longitudinal axis 3 of the container 1—this opening 6 widens towards the top.

The pump housing 5 of the piston pump 2 is connected to the container 1 both at the lower end by a common screw thread extension 7 and additionally by a narrow crossbar 8 and also at the upper end by crossbars 9, 10. The pump housing 5 and the container 1 are advantageously produced in one piece from impact-resistant plastic in an injection moulding process.

The container 1 is provided at its upper end with a screwable cover 11. At the lower end the container 1 is closed by a screwable base 12. The diameter of this base 12 is somewhat greater than the sum of the diameters of the container 1 and the pump housing 5, so that the vertical projection of the pump housing 5 lies within the outline of the base 12.

Figure 2:
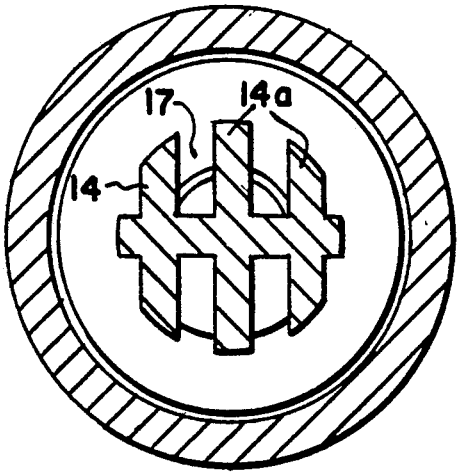
FIGS. 2 to 4 show sections along the lines II—II, III—III and IV—IV respectively.
Figure 3:
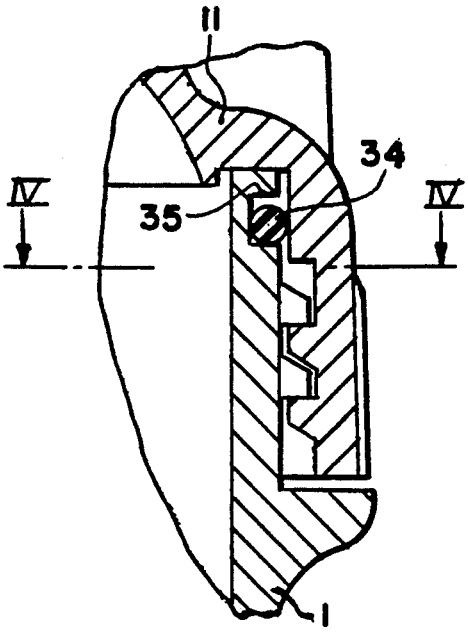

The piston pump 2 contains a piston 13 which is fixed on the lower end of a piston rod 14 having a pump handle 15 on the upper end. The pump housing 5 is closed at the upper end by a screw cap 16 through which the piston rod 14 passes so as to be slidably movable. The piston rod 14 is profiled on its periphery (cf. FIG. 2) so that between the flanges 14*a* of the piston rod 14 longitudinal channels 17 are formed, and when a safety valve 18 provided in the piston 13 is actuated air can escape via the the longitudinal channels through the bore of the screw cap 16 in which the piston rod 14 is slidably guided.

A non-return valve 21 is set directly on the base 19 of the pump pressure chamber 20. The non-return valve 21 contains a cup-shaped valve body 22 which is open towards the pump pressure chamber 20 and has in its peripheral wall at least one air hole 23 which is covered towards the exterior by an elastic sleeve 24.

Figure 5:
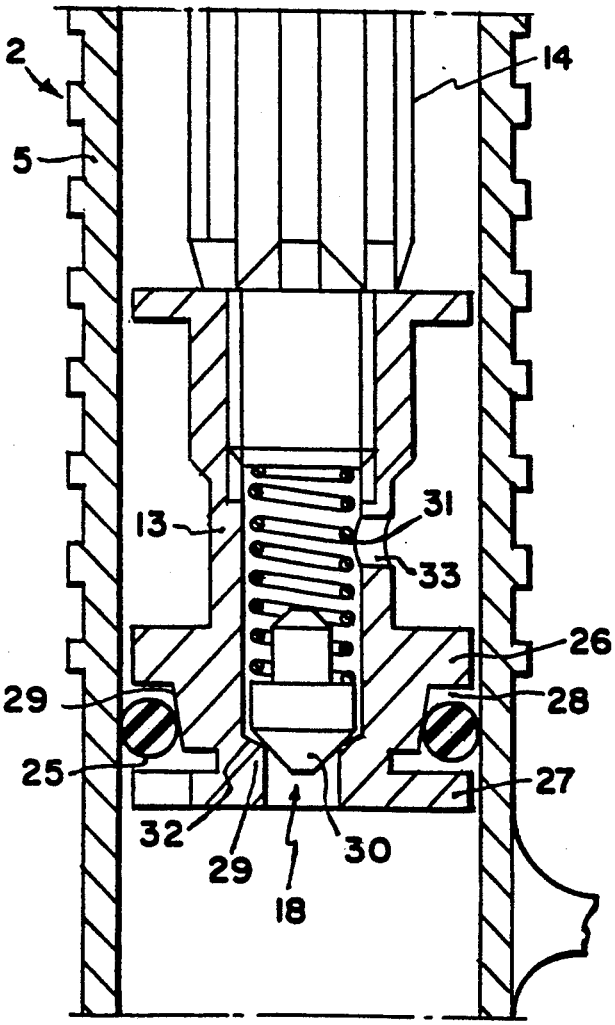
FIGS. 5 and 6 show particulars (on an enlarged scale) of the details V and VI respectively according to FIG. 1.
Figure 4:
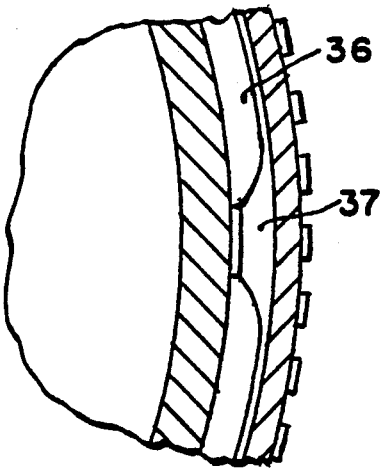
Figure 6:
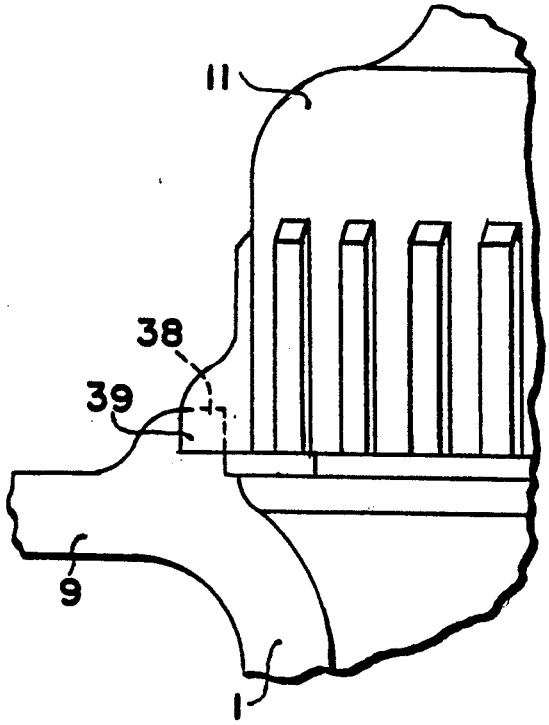
Figure 7:
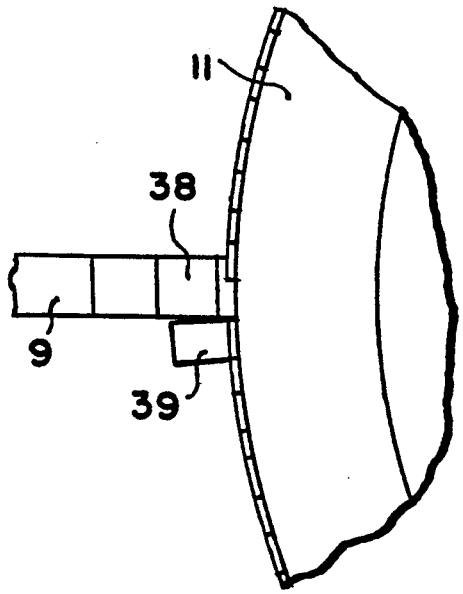
FIG. 7 is a plan view of the detail according to FIG. 6.

The piston 13 which is illustrated in detail in FIG. 5 contains a sealing ring 25 which is arranged in a groove 28 defined by two flanges 26, 27 and having a conical inner wall 29.

The safety valve 18 arranged in the piston 13 contains a valve body 30 which is pressed onto the valve seat 32 by a spring 31. In the wall surrounding the spring 31 is an air hole 33.

The sealing ring 34, which is provided in a groove 35 of the container 1, is arranged between the cover 11 and the container 1.

In order to form an air vent valve, the screw thread 36 of the container 1 is provided with at least one air vent channel 37 which runs parallel to the longitudinal axis 3. The way in which this air vent channel functions will be explained in greater detail below.

The container 1 and the cover 11 are provided with stops 38 and 39 respectively which limit the rotary movement of the cover 11 in the closed position.

The hemispherical cover 11 is provided on its outer surface with ribs 40 which serve as aids to gripping and facilitate effortless firm turning of the cover (as far as the stop position).

A sealing ring 41 is also provided between the base 12 and the screw thread extension 7 of the container and pump housing 5. The hemispherical base 12 is provided on its outer surface with ribs 42 which serve as feet for it to stand on.

The outer wall of the pump housing 5 has a profile 5*a* by means of which the grip on the pump housing 5, which is constructed as a handle, is improved.

Just like the container 1 which is produced in one piece with the pump housing 5, so the cover 11, the base 12, and the pump handle are produced in one piece. The piston rod 14 and the screw cap 16 of the pump housing 5 are produced from impact-resistant plastic in an injection moulding process.

The piston 13 is advantageously produced from a plastic with good sliding ability and a high resistance to abrasion.

The device according to the invention functions as follows:

After opening of the cover 11, several tennis balls can be placed in the container 1. The container 1 is advantageously dimensioned so that it accommodates four tennis balls, since tennis balls are predominantly sold in pressure packs containing four balls. After the cover 11 has been closed, the piston pump 2 is then actuated with the pump handle 15. For this the user holds the device on the pump housing 5, which forms a comfortable and secure handle. Since even in the inserted state the pump handle 15 projects over the container 1, secure pumping is guaranteed without any danger of injury.

If the piston 13 moves downwards during the pumping operation, then the sealing ring 25 is pressed into the narrowed upper part of the groove 28 and thus seals the sliding gap on the periphery of the flange 26. The air is consequently forced out of the pump pressure chamber 20 through the non-return valve 21 into the interior of the container 1. During the upward movement of the piston 13 the sealing ring 25 is located in the lower, wider part of the groove 28, so that air can flow into the pump pressure chamber 20.

If after several pump movements the pressure in the container 1 has reached the predetermined value (advantageously the value below which tennis balls new from the factory are pressure packed in packages). Then during a further pump movement the safety valve 18 provided in the piston 13 opens. The valve body 30 is lifted off from the valve seat 32 and allows air to flow off out of the pump pressure chamber 20 via the air hole 33 and the longitudinal channels 17 of the piston rod 14 and towards the exterior. The noise produced hereby indicates to the user that the optimum pressure for storing the tennis balls has been reached.

In order to remove the tennis balls from the container 1, it is sufficient to turn the cover 11 in the direction of opening. After a first partial rotation of the cover 11 an air vent connection is produced via the air vent channels 37 between the interior of the container 1 and the external atmosphere. It is by means of this air vent connection that the excess pressure in the container is released before the cover 11 can be removed. Therefore, even in the case of rapid release of the cover any possible danger of the cover flying off under the effect of the internal excess pressure is excluded. Only after a further partial rotation of the cover 11 and after the excess pressure in the container has already been released is it possible to take the cover 11 off.

The device according to the invention is thus distinguished by very comfortable and user-friendly handling. The pump housing 5 forms not only a secure handle in the pumping operation as well as in the insertion and removal of the tennis balls, but also facilitates comfortable carrying of the device when going to and from the tennis court.

The storage of the tennis balls under optimum pressure avoids the loss of quality which is otherwise inevitable, for example after the first opening of pressure-packed tennis balls or after the tennis balls have been stored for a long time, since the air or the gas in the tennis ball diffuses relatively rapidly through the pores of the rubber cover even if the balls have not been played with.

This otherwise unavoidable pressure loss drastically alters the bounce of tennis balls continuously so that the entire co-ordination of a player's strokes is inevitably affected unfavourably.

By storing the tennis balls under pressure in the container according to the invention the diffusion of air or gas out of the tennis balls is avoided and the tennis balls retain a uniform perfect playability. This facilitates a constant bounce of the tennis balls and thus an undisturbed co-ordination of strokes. In addition, the actual useful life of tennis balls is considerably increased, especially for tennis players who do not play very frequently. Moreover, the constant optimum playability of the tennis balls spares the tennis arm of the players quite considerably.

Finally, the construction of the device also has significant advantages as regards production, assembly and maintenance. For instance the safety valve 18 is readily accessible after release of the screw cap 16 and drawing out of the piston rod 14. If required, the non-return valve 21 can be checked and if necessary replaced by simple unscrewing of the base 12.

We claim:

1. Device for storing tennis balls under pressure, comprising (a) a tubular container (1) which is provided with a screwable cover (11) on at least one end, (b) a piston pump (2) with a pump housing (5) arranged adjacent to the container (1) and connected to one end region of the container and with a piston (13) which is movable in the pump housing by means of a pump handle (15), (c) a non-return valve (21) which connects the pump pressure chamber (20) to the interior of the container (1), characterised by the following feature:

(d) the pump housing, which is constructed as a handle, is also connected to the other end region of the container (10) so that there is an opening (6) for a hand to reach through between the pump housing (5) and the container (1), and in the inserted state the pump handle (15) also projects over the container (1).

2. Device as claimed in claim 1, characterised in that the longitudinal axis (3) of the container (1) is bent in the central region of the height of the container so that the upper section (1*a*) of the container extends parallel to the axis (4) of the pump housing (5), whilst the lower section (1*b*) of the container forms an acute angle with the axis of the pump housing, so that the opening (6) for a hand to reach through widens towards the top.

3. Device as claimed in claim 1, characterised in that the container (1) is provided on its lower end facing away from the pump handle (15) with a screwable base (12) the diameter of which corresponds at least to the sum of the diameters of the container (1) and the pump housing (5).

4. Device as claimed in claim 3, characterised in that the hemispherical screwable base (12) is provided on its outer surface with ribs (42) which serve as feet for it to stand on.

5. Device as claimed in claim 1, characterised in that the piston (13) is provided with a safety valve (18) which serves to limit the pressure which can be reached in the pump pressure chamber and in the interior of the container (1).

6. Device as claimed in claim 1, characterised in that in order to form an air vent valve the screw thread (36) of the container (1) is provided with at least one air vent channel (37) which is arranged in such a way that after a first partial rotation of the cover (11) air enters the interior of the container and only after a further partial rotation is it possible to remove the cover (11).

7. Device as claimed in claim 1, characterised in that the non-return valve (21) which is set directly on the base (19) of the pump pressure chamber (20) has a cup-shaped valve body (22) which is open towards the pump pressure chamber and has in its peripheral wall at least one air hole (23) which is covered towards the exterior by an elastic sleeve (24).

8. Device as claimed in claim 1, characterised in that the container (1) and the cover (11) are provided with stops (38 and 39 respectively) to limit the rotary movement of the cover in the closed position.

9. Device as claimed in claim 1, characterised in that the outer wall of the pump housing (5) is provided with a profile (5*a*) which increases the grip.

10. Device as claimed in claim 1, characterised in that the hemispherical cover (11) is provided on its outer surface with ribs (40) which serve as hand grips.

11. A device as set forth in claim 3 further characterized by including a piston rod (14) extending between said piston (13) and said pump handle (15), said pump handle (15) being slideably supported by and extending through a screw cap (16) which is threadably and removably disposed at the top of said pump housing (5).

12. Device as claimed in claim 11, characterized in that the container (1) which is produced in one piece with the pump housing (5), the base (12), the cover (11) the pump handle (15) which is produced in one piece with the piston rod (14) and the screw cap (16) of the pump housing (5) are produced from impact resistant plastic in an injection molding process.

* * * * *